US011802021B2

(12) United States Patent
Babu

(10) Patent No.: US 11,802,021 B2
(45) Date of Patent: Oct. 31, 2023

(54) LOCKING DEVICE FOR A GUIDE RAIL AND A METHOD THEREOF

(71) Applicant: Killakathu Ramanathan Babu, Tamilnadu (IN)

(72) Inventor: Killakathu Ramanathan Babu, Tamilnadu (IN)

(73) Assignee: Killakathu Ramanathan Babu

( * ) Notice: Subject to any disclaimer, the term of this patent is extended or adjusted under 35 U.S.C. 154(b) by 0 days.

(21) Appl. No.: 17/928,626

(22) PCT Filed: May 28, 2021

(86) PCT No.: PCT/IB2021/054674
§ 371 (c)(1),
(2) Date: Nov. 30, 2022

(87) PCT Pub. No.: WO2021/245510
PCT Pub. Date: Dec. 9, 2021

(65) Prior Publication Data

US 2023/0126885 A1 Apr. 27, 2023

(30) Foreign Application Priority Data

Jun. 2, 2020 (IN) ..... 202041023080

(51) Int. Cl.
*B66B 7/02* (2006.01)
*B66B 9/04* (2006.01)

(52) U.S. Cl.
CPC ..... *B66B 7/026* (2013.01); *B66B 9/04* (2013.01)

(58) Field of Classification Search
CPC ..... B66B 9/04; B66B 7/024; B66B 7/026
See application file for complete search history.

(56) References Cited

U.S. PATENT DOCUMENTS 2,927,661 A * 3/1960 Kristek ..... B66B 9/04 187/360
3,949,953 A * 4/1976 Hopkins ..... B65G 51/06 406/185
5,005,672 A * 4/1991 Nakai ..... H02K 41/025 187/250
5,181,807 A * 1/1993 Anders ..... B65G 51/06 406/190

(Continued)

FOREIGN PATENT DOCUMENTS

CN 103863918 A 6/2014
EP 3498650 A2 6/2019

(Continued)

*Primary Examiner* — Michael A Riegelman
(74) *Attorney, Agent, or Firm* — Jason C. Cameron

(57) ABSTRACT

A locking device for a guide rail is disclosed. The device includes a first edge including a plurality of teeth shaped projections. The first edge compresses and locks a first surface of a covering sheet placed on a base ring. The device also includes a second edge opposing the first edge. The second edge includes a V-shaped groove, wherein the second edge is disposed to hold at least one furrow of the guide rail for interlocking. The first edge and the second edge of the locking device locks air gap between the covering sheet, the guide rail connecting one or more surfaces of the base ring and a vertical pillar coupled to the guide rail.

9 Claims, 3 Drawing Sheets

(56) References Cited

U.S. PATENT DOCUMENTS

Figure 1A:
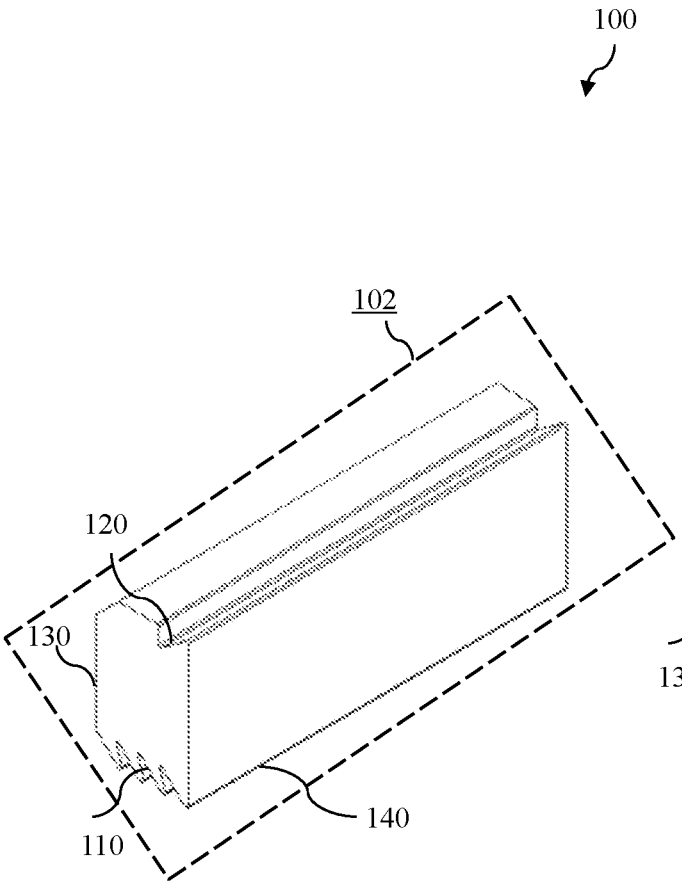

| | | | | | |
|---|---|---|---|---|---|
| 5,447,211 | A * | 9/1995 | Sors | B66B 9/04 | 187/277 |
| 5,512,791 | A * | 4/1996 | Cho | H02K 41/02 | 187/250 |
| 5,583,326 | A * | 12/1996 | Sors | B66B 9/04 | 187/277 |
| 9,617,121 | B2 * | 4/2017 | Bolme | B66B 19/002 | |
| 10,233,055 | B1 * | 3/2019 | Ascua | B66B 11/026 | |
| 2002/0029938 | A1 * | 3/2002 | Sors | B66B 17/12 | 187/345 |
| 2023/0126885 | A1 * | 4/2023 | Babu | B66B 7/024 | 187/408 |

FOREIGN PATENT DOCUMENTS

| | | | | |
|---|---|---|---|---|
| KR | 20180073037 | A | | 7/2018 |
| WO | WO-2021245455 | A1 | * | 12/2021 |
| WO | WO-2022175730 | A1 | * | 8/2022 |
| WO | WO-2023021322 | A1 | * | 2/2023 |

* cited by examiner

LOCKING DEVICE FOR A GUIDE RAIL AND A METHOD THEREOF

CROSS-REFERENCE TO RELATED APPLICATION

This application claims priority from a patent application filed in India having Patent Application No. 202041023080, filed on Jun. 2, 2020, and titled "A LOCKING DEVICE FOR A GUIDE RAIL AND A METHOD THEREOF" and a PCT Application No. PCT/IB2021/054674 filed on May 28, 2021, and titled "A LOCKING DEVICE FOR A GUIDE RAIL AND A METHOD THEREOF".

BACKGROUND

Embodiments of the present disclosure relate to a pneumatic vacuum elevator and more particularly, to a device that lock air gap between the guide rail of the pneumatic vacuum elevator.

Pneumatic vacuum elevators are typically used in countervailing weights in order to facilitate a cabin moving up and down between various layers or floors at various heights inside the vertical passageways of office buildings, hospitals, factories and similar structures. The pneumatic vacuum elevators use air pressure to cause the motion of the cabin within a thoroughfare or tubular cylinder that uses the air within it as a working fluid upon the confines of the cabin. Transmission of the pneumatic vacuum elevators is supported and guided by a mechanical device such as a guide rail. The guide rail is a part of an inner working mechanism of most of the pneumatic vacuum elevators. The guide rail connects with various components of the pneumatic vacuum elevator and enables smooth movement of the cabin across the various floors. Generally, in many of the pneumatic elevators, structure of the guide rail while connecting with the various other components does not get assembled properly and leads to generation of the air gap. Such air gap causes improper functioning of the pneumatic elevator and causes unpleasant riding experience to the passenger. As a result, various locking devices are available which seals the air gap between the guide rail and the various other components.

Conventionally, the locking device available in the market is of elementary structural design which locks the guide rail with the other components of the pneumatic vacuum elevator. However, such a conventional locking device is fixed with the guide rail which is pre-assembled during manufacturing. Also, assembling duration of the locking device is time-consuming and expensive. Moreover, the locking device affixed with the guide rail leaves the air gap, as a result, obtaining an appropriate and a compact design and the structure for the elevator is difficult. Furthermore, the air gap generated leads to lose connectivity between different components of the pneumatic elevator and further causes vibration while transiting.

Hence, there is a need for an improved locking device for a guide rail and a method thereof in order to address the aforementioned issues.

BRIEF DESCRIPTION

In accordance with one embodiment of a present disclosure, a locking device for a guide rail is disclosed. The device includes a first edge including a plurality of teeth shaped projections. The first edge compresses and locks a first surface of a covering sheet placed on a base ring. The device also includes a second edge opposing the first edge. The second edge includes a V-shaped groove. The second edge is disposed to hold an outer furrow of the guide rail for interlocking. The first edge and the second edge of the locking device locks air gap between the covering sheet and the guide rail connecting one or more surfaces of the base ring.

In accordance with another embodiment of the present disclosure, a method for providing a locking mechanism to a guide rail is disclosed. The method includes forming a first edge of a locking device including a plurality of teeth shaped projections for compressing and locking a first surface of a covering sheet placed on a base ring. The method also includes forming a second edge of the locking device including a V-shaped groove in opposition to the first edge, wherein the second edge is disposed to hold an outer furrow of the guide rail for interlocking. The method also includes adhering the first edge and the second edge of the locking device to lock air gap between the covering sheet and the guide rail connecting one or more surfaces of the base ring.

In accordance with yet another embodiment of the present disclosure, a pneumatic vacuum elevator with a locking device for a guide rail is disclosed. The pneumatic vacuum elevator includes a guide rail disposed at an external cylinder assembly. The guide rail guides an actuation of a cabin of the pneumatic vacuum elevator. The pneumatic vacuum elevator also includes a locking device mechanically coupled to the guide rail. The locking device includes a first edge including a plurality of teeth shaped projections. The first edge compresses and locks a first surface of a covering sheet placed on a base ring. The device also includes a second edge opposing to the first edge. The second edge includes a V-shaped groove, wherein the second edge is disposed to hold an outer furrow of the guide rail for interlocking. The first edge and the second edge of the locking device locks air gap between the covering sheet and the guide rail connecting one or more surfaces of the base ring.

Figure 1:
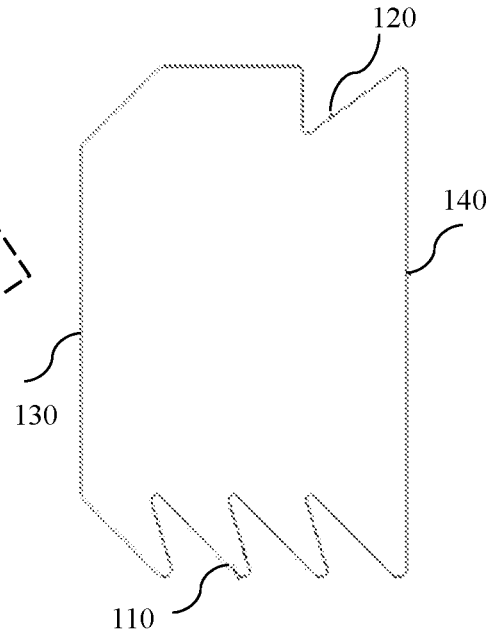
Figure 2:
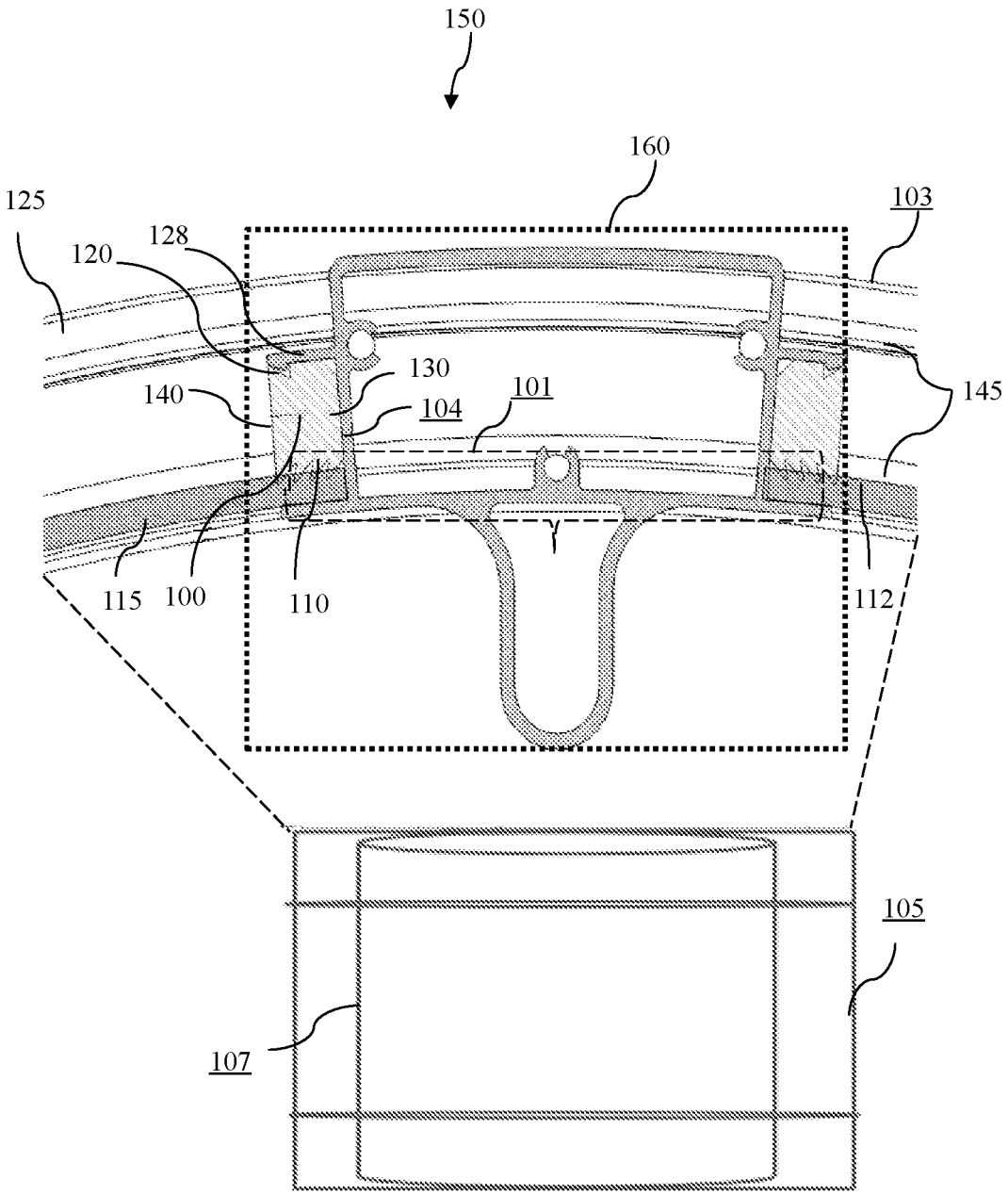
Figure 3:
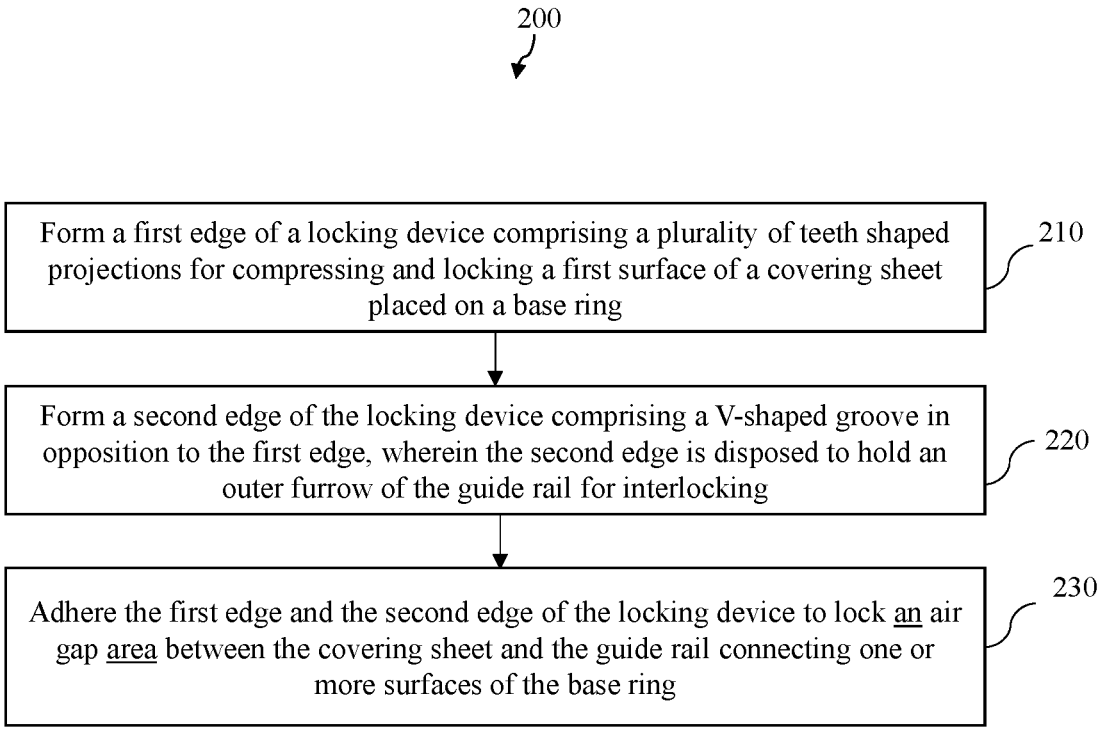

FIG. 1 is a schematic representation of a sectional view of a locking device for a guide rail in accordance with an embodiment of the present disclosure;

FIG. 2 illustrates a schematic representation of an assembled cross section view of an embodiment of a guide rail with a locking device in accordance with an embodiment of the present disclosure; and FIG. 3 is a flow chart representing the steps involved in a method for providing locking mechanism to a guide rail of a pneumatic vacuum elevator in accordance with the embodiment of the present disclosure.

Further, those skilled in the art will appreciate that elements in the figures are illustrated for simplicity and may not have necessarily been drawn to scale. Furthermore, in terms of the construction of the device, one or more components of the device may have been represented in the figures by conventional symbols, and the figures may show only those specific details that are pertinent to understanding the embodiments of the present disclosure so as not to obscure the figures with details that will be readily apparent to those skilled in the art having the benefit of the description herein.

DETAILED DESCRIPTION

For the purpose of promoting an understanding of the principles of the disclosure, reference will now be made to the embodiment illustrated in the figures and specific language will be used to describe them. It will nevertheless be understood that no limitation of the scope of the disclosure is thereby intended. Such alterations and further modifications in the illustrated system, and such further applications of the principles of the disclosure as would normally occur to those skilled in the art are to be construed as being within the scope of the present disclosure.

The terms "comprises", "comprising", or any other variations thereof, are intended to cover a non-exclusive inclusion, such that a process or method that comprises a list of steps does not include only those steps but may include other steps not expressly listed or inherent to such a process or method. Similarly, one or more devices or sub-systems or elements or structures or components preceded by "comprises . . . a" does not, without more constraints, preclude the existence of other devices, sub-systems, elements, structures, components, additional devices, additional sub-systems, additional elements, additional structures or additional components. Appearances of the phrase "in an embodiment", "in another embodiment" and similar language throughout this specification may, but not necessarily do, all refer to the same embodiment.

Unless otherwise defined, all technical and scientific terms used herein have the same meaning as commonly understood by those skilled in the art to which this disclosure belongs. The system, methods, and examples provided herein are only illustrative and not intended to be limiting.

In the following specification and the claims, reference will be made to a number of terms, which shall be defined to have the following meanings. The singular forms "a", "an", and "the" include plural references unless the context clearly dictates otherwise.

Embodiments of the present disclosure relate to a locking device of a guide rail. The device includes a first edge including a plurality of teeth shaped projections. The first edge compresses and locks a first surface of a covering sheet placed on a base ring. The device also includes a second edge opposing the first edge. The second edge includes a V-shaped groove, wherein the second edge is disposed to hold an outer furrow of the guide rail for interlocking. The first edge and the second edge of the locking device locks air gap between the covering sheet and the guide rail connecting one or more surfaces of the base ring.

FIG. 1 is a schematic representation of a sectional view of a locking device for a guide rail in accordance with an embodiment of the present disclosure. FIG. 1 (*a*) illustrates a sectional view of an embodiment of a locking device 100 for a guide rail of FIG. 1. Similarly, FIG. 1 (*b*) illustrates a schematic representation of an isometric view of an embodiment of a locking device 100 for a guide rail of FIG. 1. As used herein, the term 'locking device' is defined as a mechanical device which prevents the guide rail and other components such as a covering sheet and a base ring from moving out of position and formation of air gap w % ben subjected to one or more external forces. In one embodiment, the locking device 100 may include a rubber block mechanically coupled with the covering sheet, the base ring and the guide rail. The device 100 includes a first edge 110 including a plurality of teeth shaped projections. The first edge 100 with the plurality of teeth shaped projections compresses and locks a first surface of a covering sheet placed on a base ring. In one embodiment, the covering sheet may be fabricated from a polycarbonate material for covering an external cylinder assembly of the pneumatic vacuum elevator. In such embodiment, the first surface of the covering sheet may include a bottom surface of the covering sheet.

The device 100 also includes a second edge 120 opposing the first edge 110. The second edge includes a V-shaped groove. The second edge 120 with the V-shaped groove is disposed to hold an outer furrow of the guide rail for interlocking. In one embodiment, the outer furrow of the guide rail may include a furrow of the guide rail extended outwards from a periphery of the guide rail. In such embodiment, the outer furrow of the guide rail is coupled with at least one rib, wherein the at least one rib is positioned on an inner side of the guide rail. In such embodiment, the at least one rib may include at least semi-circular shaped rib. The first edge 110 and the second edge 120 of the locking device 100 locks air gap between the covering sheet and the guide rail connecting one or more surfaces of the base ring. The air gap is locked from the inside of an external cylinder assembly of the pneumatic vacuum elevator as the covering sheet for the external cylinder assembly is locked and compressed, wherein the covering sheet is placed at the vertical direction of guide rail-vertical pillar.

In a specific embodiment, the device 100 also includes a third edge 130 adjoining the first edge 110 and the second edge 120. The third edge 130 is positioned for holding a first surface of the guide rail. In such embodiment, the first surface of the guide rail may include an interior surface of the guide rail. In a preferred embodiment, the device 100 also includes a fourth edge 140 having an open space, wherein the fourth edge 140 is placed in a gap between two rims of the base ring coupled to the guide rail. The fourth edge 140 includes a flat edge disposed in perpendicular to the two rims of the base ring. In one embodiment, the two rims of the base ring may include an inner rim and an outer rim of the base ring. In such embodiment, shape of geometry of the base ring may include a round shape geometry.

FIG. 2 illustrates a schematic representation of an assembled cross section view of an embodiment 150 of a guide rail 160 with a locking device 100 in accordance with an embodiment of the present disclosure. The locking device as used herein, is substantially similar to a locking device 100 of FIG. 1. The pneumatic vacuum elevator includes a guide rail 160 disposed at an external cylinder assembly. The external cylinder assembly also includes a cabin to carry a passenger. The guide rail 160 disposed at the external cylinder assembly guides an actuation of the cabin of the pneumatic vacuum elevator. In one embodiment, the guide rail 160 may include a guide rail manufactured from aluminium metal.

The pneumatic vacuum elevator also includes a locking device 100 mechanically coupled to the guide rail 160. The locking device 100 includes a first edge 110 including a plurality of teeth shaped projections. In one embodiment, the locking device 100 may include a rubber block mechanically coupled with the covering sheet 115, the base ring 125 and the guide rail 160. The first edge 110 compresses and locks a first surface 112 of the covering sheet 115 placed on the base ring 125. The first edge 110 is cut and shaped into the plurality of teeth shaped projections for receiving the first surface of the covering sheet 115 and grasping the first surface 112 of the covering sheet 115. Once, the first surface 112 of the covering sheet 115 is grasped, the plurality of teeth shaped projections of the first edge 110 pushes, compresses and locks a bottom surface of the covering sheet 115 placed on the base ring 125. In one embodiment, the covering sheet 115 may be fabricated from a polycarbonate material for covering the external cylinder assembly of the pneumatic vacuum elevator.

The device 100 also includes a second edge 120 opposing to the first edge 110. The second edge 120 includes a V-shaped groove, wherein the second edge 120 is disposed to hold an outer furrow 128 of the guide rail 160 for interlocking. The V-shaped groove of the second edge 120 opposing the first edge 110 is also formed by cutting and reshaping to hold the outer furrow 128 which is extended outwards from a periphery of the guide rail 160. The V-shaped groove of the second edge 120 receives the outer furrow 128 of the guide rail 160 and interlocks an end of the outer furrow 128 within the V-shaped groove to lock the air gap. The first edge 110 and the second edge 120 of the locking device 100 locks the air gap between the covering sheet 115 and the guide rail 160 connecting one or more surfaces of the base ring 125.

Further, the locking device 100 also includes a third edge 130 adjoining the first edge 110 and the second edge 120. The third edge 130 is positioned for holding a first surface of the guide rail 160. In one embodiment, the first surface of the guide rail 160 may include an interior surface. The third edge 130 with a linear edge is disposed towards the periphery of the guide rail 160 for holding and interlocking the guide rail. In a particular embodiment, the device 100 further includes a fourth edge 140 having an open space, wherein the fourth edge 140 is placed in a gap between two rims 145 of the base ring 125 coupled to the guide rail 160. In one embodiment, the base ring may be fabricated from a metal. In one limiting example, the metal may include an aluminum metal. The fourth edge 140 includes a flat edge disposed in perpendicular to the two rims 145 of the base ring 125. In one embodiment, the two rims 145 of the base ring may include an inner rim and an outer rim of the base ring. Thus, an overall structure of the locking device 100 which is manufactured from a flexible material which fits with different components of the pneumatic vacuum elevator and eliminates the air gap for smooth functioning of the guide rail 160 to guide the actuation of the cabin.

FIG. 3 is a flow chart representing the steps involved in a method 200 for providing locking mechanism to a guide rail of a pneumatic vacuum elevator in accordance with the embodiment of the present disclosure. The method 200 includes forming a first edge of a locking device with a plurality of teeth shaped projections for compressing and locking a first surface of a covering sheet placed on a base ring in step 210. In one embodiment, forming the first edge of the locking device with the plurality of teeth shaped projections may include forming the first edge of a rubber block by cutting and shaping the rubber block to enable fixing of the first surface of the covering sheet. In such embodiment, forming the first edge of the locking device may include forming the first edge with the plurality of teeth shaped projections for grasping, compressing and locking a bottom surface of a poly carbonate sheet.

The method 200 also includes forming a second edge of the locking device including a V-shaped groove in opposition to the first edge, wherein the second edge is disposed to hold an outer furrow of the guide rail for interlocking in step 220. In one embodiment, forming the second edge of the locking device in opposition to the first edge may include forming the second edge with a V-shaped groove to hold the outer furrow of the guide rail fabricated from aluminum metal. In such embodiment forming the second edge may include forming the second edge with the V-groove of a similar shape and size corresponding to the outer furrow. In such embodiment, forming the V-shaped groove may include forming the V-shaped groove for firmly holding the outer furrow of the guide rail extended outwards from a periphery of the guide rail and interlocking an end of the outer furrow.

The method 200 also includes adhering the first edge and the second edge of the locking device to lock air gap between the covering sheet and the guide rail connecting one or more surfaces of the base ring in step 230. In one embodiment, adhering the first edge and the second edge of the locking device may include adhering the first edge and the second edge for interlocking the covering sheet placed on the base ring and the outer furrow of the guide rail respectively in order to lock the air gap between the covering sheet and the guide rail connecting one or more surfaces of the base ring. The air gap is locked from the inside of an external cylinder assembly of the pneumatic vacuum elevator, as the covering sheet for the external cylinder assembly is locked and compressed, wherein the covering sheet is placed at the vertical direction of guide rail-vertical pillar.

In a specific embodiment, the method 200 further includes forming a third edge adjoining the first edge and the second edge of the locking device, wherein the third edge is positioned for holding a first surface of the guide rail. In such embodiment, the first surface of the guide rail may include an interior surface of the guide rail. In a particular embodiment, the method 200 further includes forming a fourth edge of the locking device, wherein the fourth edge is having an open space and placed in a gap between two rims of the base ring coupled to the guide rail.

Various embodiments of the present disclosure relate to a locking device used for the guide rail used in the pneumatic vacuum elevator for eliminating the air gap between one or more components of the pneumatic vacuum eliminator and as a result helps in making the structure of the guide rail compact and structured and also requires less effort during installation or uninstallation process.

Moreover, the present disclosed device also includes the locking device which is manufactured from a light weight and a flexible material which is easily available and also cost effective.

Furthermore, the present disclosed device helps in providing the locking mechanism to the guide rail by avoiding formation of the air gap which not only keeps the guide rail in an intact position but also does not affect smooth functioning of the guide rail in guiding the actuation of the cabin of the pneumatic vacuum elevator for transiting.

It will be understood by those skilled in the art that the foregoing general description and the following detailed description are exemplary and explanatory of the disclosure and are not intended to be restrictive thereof.

While specific language has been used to describe the disclosure, any limitations arising on account of the same are not intended. As would be apparent to a person skilled in the art, various working modifications may be made to the method in order to implement the inventive concept as taught herein.

The figures and the foregoing description give examples of embodiments. Those skilled in the art will appreciate that one or more of the described elements may well be combined into a single functional element. Alternatively, certain elements may be split into multiple functional elements. Elements from one embodiment may be added to another embodiment. For example, the order of processes described herein may be changed and are not limited to the manner described herein. Moreover, the actions of any flow diagram need not be implemented in the order shown; nor do all of the acts need to be necessarily performed. Also, those acts that are not dependent on other acts may be performed in parallel with the other acts. The scope of embodiments is by no means limited by these specific examples

I claim:

1. A locking device for a guide rail comprising:

a first edge comprising a plurality of teeth shaped projections, wherein the first edge is configured to compress and lock a first surface of a covering sheet placed on a base ring; and a second edge opposing the first edge, wherein the second edge comprises a V-shaped groove, wherein the second edge is disposed to hold an outer furrow of the guide rail for interlocking, wherein the first edge and the second edge of the locking device is configured to lock an air gap area between the covering sheet and the guide rail connecting one or more surfaces of the base ring.

2. The device as claimed in claim 1, wherein the device is composed of a rubber block, wherein the rubber block is mechanically coupled with the covering sheet, the base ring and the guide rail.

3. The device as claimed in claim 1, wherein the covering sheet is fabricated from a polycarbonate material for covering an external cylinder assembly of a pneumatic vacuum elevator.

4. The device as claimed in claim 1, wherein the first surface of the covering sheet comprises a bottom surface of the covering sheet, wherein the covering sheet is placed on the base ring.

5. The device as claimed in claim 1, comprising a third edge adjoining the first edge and the second edge, wherein the third edge is positioned for holding a first surface of the guide rail.

6. The device as claimed in claim 5, wherein the first surface of the guide rail comprises an interior surface of the guide rail.

7. The device as claimed in claim 1, comprising a fourth edge having an open space, wherein the fourth edge is placed in a gap between two rims of the base ring coupled to the guide rail.

8. A pneumatic vacuum elevator with a locking device for a guide rail comprising:

a guide rail disposed at an external cylinder assembly, wherein the guide rail is configured to guide an actuation of a cabin of the pneumatic vacuum elevator; and a locking device mechanically coupled to the guide rail, wherein the locking device comprises:

a first edge comprising a plurality of teeth shaped projections, wherein the first edge is configured to compress and lock a first surface of a covering sheet placed on a base ring; and a second edge opposing to the first edge, wherein the second edge comprises a V-shaped groove, wherein the second edge is disposed to hold an outer furrow of the guide rail for interlocking, wherein the first edge and the second edge of the locking device is configured to lock air gap between the covering sheet and the guide rail connecting one or more surfaces of the base ring.

9. A method for providing a locking mechanism to a guide rail comprising:

forming a first edge of a locking device comprising a plurality of teeth shaped projections for compressing and locking a first surface of a covering sheet placed on a base ring;

forming a second edge of the locking device comprising a V-shaped groove in opposition to the first edge, wherein the second edge is disposed to hold an outer furrow of the guide rail for interlocking; and adhering the first edge and the second edge of the locking device to lock air gap between the covering sheet and the guide rail connecting one or more surfaces of the base ring.

* * * * *